US008955523B2

(12) United States Patent
Coleman, III et al.

(10) Patent No.: US 8,955,523 B2
(45) Date of Patent: Feb. 17, 2015

(54) TOBACCO-DERIVED COMPONENTS AND MATERIALS

(75) Inventors: William Monroe Coleman, III, Winston-Salem, NC (US); Michael Francis Dube, Winston-Salem, NC (US); Darlene Madeline Lawson, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1025 days.

(21) Appl. No.: 12/688,294

(22) Filed: Jan. 15, 2010

(65) Prior Publication Data

US 2011/0174323 A1 Jul. 21, 2011

(51) Int. Cl.
*A24B 15/26* (2006.01)
*A24B 15/30* (2006.01)
*A24B 15/24* (2006.01)

(52) U.S. Cl.
CPC ..... *A24B 15/302* (2013.01); *A24B 15/24* (2013.01); *A24B 15/307* (2013.01)
USPC ..... 131/298; 131/352; 131/297; 131/290; 131/275

(58) Field of Classification Search
None
See application file for complete search history.

(56) References Cited

U.S. PATENT DOCUMENTS

| | | | | |
|---|---|---|---|---|
| 1,376,586 | A | 5/1921 | Schwartz | |
| 3,424,171 | A | 1/1969 | Rooker | |
| 3,476,118 | A | 11/1969 | Luttich | |
| 4,144,895 | A | 3/1979 | Fiore | |
| 4,150,677 | A | 4/1979 | Osborne, Jr. et al. | |
| 4,267,847 | A * | 5/1981 | Reid | 131/275 |
| 4,268,632 | A | 5/1981 | Wildman et al. | |
| 4,289,147 | A | 9/1981 | Wildman et al. | |
| 4,347,324 | A | 8/1982 | Wildman et al. | |
| 4,351,346 | A | 9/1982 | Brummer et al. | |
| 4,359,059 | A | 11/1982 | Brummer et al. | |
| 4,506,682 | A | 3/1985 | Muller | |
| 4,513,756 | A | 4/1985 | Pittman et al. | |
| 4,528,993 | A | 7/1985 | Sensabaugh, Jr. et al. | |
| 4,589,428 | A | 5/1986 | Keritsis | |
| 4,605,016 | A | 8/1986 | Soga et al. | |
| 4,612,942 | A * | 9/1986 | Dobberstein et al. | 131/276 |
| 4,624,269 | A | 11/1986 | Story et al. | |
| 4,660,577 | A | 4/1987 | Sensabaugh et al. | |
| 4,716,911 | A | 1/1988 | Poulose et al. | |
| 4,727,889 | A | 3/1988 | Niven, Jr. et al. | |
| 4,819,668 | A | 4/1989 | Shelar et al. | |
| 4,887,618 | A | 12/1989 | Bernasek et al. | |
| 4,941,484 | A * | 7/1990 | Clapp et al. | 131/297 |
| 4,967,771 | A | 11/1990 | Fagg et al. | |
| 4,986,286 | A | 1/1991 | Roberts et al. | |
| 4,987,907 | A | 1/1991 | Townend | |
| 5,005,593 | A | 4/1991 | Fagg | |
| 5,018,540 | A | 5/1991 | Grubbs et al. | |
| 5,060,669 | A | 10/1991 | White et al. | |
| 5,065,775 | A | 11/1991 | Fagg | |
| 5,074,319 | A | 12/1991 | White et al. | |
| 5,092,352 | A | 3/1992 | Sprinkle, III et al. | |
| 5,099,862 | A | 3/1992 | White et al. | |
| 5,121,757 | A | 6/1992 | White et al. | |
| 5,131,414 | A | 7/1992 | Fagg et al. | |
| 5,131,415 | A | 7/1992 | Munoz et al. | |
| 5,143,097 | A | 9/1992 | Sohn et al. | |
| 5,148,819 | A | 9/1992 | Fagg | |
| 5,159,942 | A | 11/1992 | Brinkley et al. | |
| 5,197,494 | A | 3/1993 | Kramer | |
| 5,230,354 | A | 7/1993 | Smith et al. | |
| 5,234,008 | A | 8/1993 | Fagg | |
| 5,235,992 | A | 8/1993 | Sensabaugh, Jr. | |
| 5,243,999 | A | 9/1993 | Smith | |
| 5,301,694 | A | 4/1994 | Raymond et al. | |
| 5,318,050 | A | 6/1994 | Gonzalez-Parra et al. | |
| 5,343,879 | A | 9/1994 | Teague | |
| 5,360,022 | A | 11/1994 | Newton et al. | |

(Continued)

FOREIGN PATENT DOCUMENTS

| | | |
|---|---|---|
| CN | 1077096 | 10/1993 |
| CN | 1077358 | 10/1993 |

(Continued)

OTHER PUBLICATIONS

Brandt et al., "Practical Aspects of Preparative HPLC in Pharmaceutical and Development Production", *LC·GC Europe,* Mar. 2002, pp. 2-5.

(Continued)

*Primary Examiner* — Richard Crispino
*Assistant Examiner* — Phu Nguyen
(74) *Attorney, Agent, or Firm* — Womble Carlyle Sandridge & Rice, LLP

(57) ABSTRACT

The invention provides a tobacco composition for use in a smoking article or a smokeless tobacco composition that includes an additive derived from a flower of the *Nicotiana* species. The additive can be a flower of the *Nicotiana* species or a portion thereof in particulate form or in the form of flower isolate derived from a flower of the *Nicotiana* species. In certain embodiments, the flower isolate is in the form of an extract from a flower of the *Nicotiana* species or in the form of a chemically transformed flower isolate, the chemical transformation being selected from acid/base reaction, hydrolysis, thermal treatment, and enzymatic treatment. The invention also provides smoking articles and smokeless tobacco compositions that include the flower additives described herein, and methods for preparing an additive derived from a flower of the *Nicotiana* species for addition to a tobacco composition.

14 Claims, No Drawings

(56) References Cited

U.S. PATENT DOCUMENTS

| | | | | |
|---|---|---|---|---|
| 5,387,416 | A | 2/1995 | White et al. | |
| 5,435,325 | A | 7/1995 | Clapp et al. | |
| 5,445,169 | A | 8/1995 | Brinkley et al. | |
| 5,598,868 | A | 2/1997 | Jakob et al. | |
| 5,715,844 | A | 2/1998 | Young et al. | |
| 5,724,998 | A | 3/1998 | Gellatly et al. | |
| 6,131,584 | A | 10/2000 | Lauterbach | |
| 6,216,706 | B1 | 4/2001 | Kumar et al. | |
| 6,298,858 | B1 | 10/2001 | Coleman, III et al. | |
| 6,298,859 | B1 * | 10/2001 | Kierulff et al. | 131/297 |
| 6,325,860 | B1 | 12/2001 | Coleman, III | |
| 6,428,624 | B1 | 8/2002 | Coleman, III et al. | |
| 6,440,223 | B1 | 8/2002 | Dube et al. | |
| 6,499,489 | B1 | 12/2002 | Coleman, III | |
| 6,591,841 | B1 | 7/2003 | White et al. | |
| 6,772,767 | B2 | 8/2004 | Mua et al. | |
| 6,895,974 | B2 | 5/2005 | Peele | |
| 6,953,040 | B2 | 10/2005 | Atchley et al. | |
| 7,025,066 | B2 | 4/2006 | Lawson et al. | |
| 7,032,601 | B2 | 4/2006 | Atchley et al. | |
| 7,337,782 | B2 | 3/2008 | Thompson | |
| 2002/0162562 | A1 | 11/2002 | Williams | |
| 2002/0162563 | A1 | 11/2002 | Williams | |
| 2004/0020503 | A1 | 2/2004 | Williams | |
| 2004/0173228 | A1 | 9/2004 | Coleman, III | |
| 2005/0178398 | A1 | 8/2005 | Breslin et al. | |
| 2005/0244521 | A1 | 11/2005 | Strickland et al. | |
| 2006/0037623 | A1 * | 2/2006 | Lawrence, Jr. | 131/352 |
| 2006/0185686 | A1 * | 8/2006 | Lawrence | 131/352 |
| 2006/0191548 | A1 | 8/2006 | Strickland et al. | |
| 2006/0198873 | A1 | 9/2006 | Chan et al. | |
| 2007/0000505 | A1 * | 1/2007 | Zhuang et al. | 131/342 |
| 2007/0062549 | A1 | 3/2007 | Holton, Jr. et al. | |
| 2007/0186941 | A1 | 8/2007 | Holton, Jr. et al. | |
| 2007/0186942 | A1 | 8/2007 | Strickland et al. | |
| 2008/0029110 | A1 * | 2/2008 | Dube et al. | 131/275 |
| 2008/0029116 | A1 | 2/2008 | Robinson et al. | |
| 2008/0029117 | A1 | 2/2008 | Mua et al. | |
| 2008/0173317 | A1 | 7/2008 | Robinson et al. | |
| 2008/0196730 | A1 | 8/2008 | Engstrom et al. | |
| 2008/0209586 | A1 | 8/2008 | Nielsen et al. | |
| 2008/0245377 | A1 | 10/2008 | Marshall et al. | |
| 2009/0293889 | A1 | 12/2009 | Kumar et al. | |
| 2010/0037903 | A1 | 2/2010 | Coleman, III et al. | |
| 2010/0116281 | A1 | 5/2010 | Marshall et al. | |

FOREIGN PATENT DOCUMENTS

| | | | |
|---|---|---|---|
| CN | 1133694 | | 10/1996 |
| EP | 1130104 | A1 * | 9/2001 |
| EP | 1208757 | B1 * | 4/2007 |
| GB | 2 020 538 | A | 11/1979 |
| WO | WO 2005/041699 | A2 | 5/2005 |
| WO | WO 2005/063060 | A1 | 7/2005 |
| WO | WO 2007/012980 | A1 | 2/2007 |
| WO | WO 2010/054198 | A2 | 5/2010 |

OTHER PUBLICATIONS

Bryzgalov et al., "Comparative Life Cycle Assessment of General Loose and Portion Snus", *1N1800 Life Cycle Assessment,* May 26, 20Q5, pp. 3-23.

Coleman, III et al., "Headspace Solid-Phase Microextraction Analysis of Artificial Flavors", *J. Sci. Food Agric.,* 2005, pp. 2645-2654, vol. 85.

Coleman, III et al., "The Use of a Non-Equilibrated Solid Phase Microextraction Method to Quantitatively Determine the Off-Notes in Mint and Other Essential Oils", *J. Sci. Food Agric.,* 2004, pp. 1223-1228, vol. 84.

Ishikawa et al., "Water-Soluble Constituents of Dill", *Chem. Pharm. Bull.,* 2002, pp. 501-507, vol. 50., No. 4.

Kodama et al., "Isolation of a New Terpene Glucoside, 3-Hydroxy-5, 6-epoxy-β-ionyl-β-D-glucopyranoside from Flue-cured Tobacco", *Agric. Biol. Chem.,* 1981, pp. 941-944, vol. 45, No. 4.

Leffingwell et al., "Tobacco Flavoring for Smoking Products", *R. J. Reynolds Tobacco Company,* 1972, pp. 1-72.

Loughrin et al., "Glycosidically Bound Volatile Components of *Nicotiana Sylvestris*and *N. Suaveolens*Flowers", *Phytochemistry,* 1992, pp. 1537-1540, vol. 31, No. 5.

Matsumura et al., "Water-Soluble Constituents of Caraway: Carvone Derivatives and their Glucosides", *Chem. Pharm. Bull.,* 2002, pp. 66-72, vol. 50, No. 1.

Ochiai, N., "6 Times Faster Screening of Pesticide Multi-Residues in Aqueous Samples Take Two!" *Gerstel Solutions Worldwide,* 2006, pp. 17-19, No. 6.

Raguso et al., "Fragrance Chemistry, Nocturnal Rhythms and Pollination "Syndromes" in *Nicotiana", Phytochemistry,* 2003, pp. 265-284, vol. 63.

Sahraoui et al., "Improved Microwave Steam Distillation Apparatus for Isolation of Essential Oils Comparison with Conventional Steam Distillation", *J. Chromatogr. A.,* 2008, pp. 229-233.

Tienpont et al., "Stir Bar Sorptive Extraction-Thermal Desorption-Capillary GC-MS Applied to Biological Fluids", *Anal. Bioanal. Chem.,* 2002, pp. 46-55, vol. 373.

Snook et al, "The Flower Flavonols of *Nicotiana*Species", *Phytochemistry,* 1992, pp. 1639-1647, vol. 31, No. 5.

Loughrin et al., "Headspace Compounds from Flowers of *Nicoitana tabacum* and Related Species", *J. Agric. Food Chem.,* 1990, vol. 38, No. 2, pp. 455-460.

* cited by examiner

TOBACCO-DERIVED COMPONENTS AND MATERIALS

FIELD OF THE INVENTION

The present invention relates to products made or derived from tobacco, or that otherwise incorporate tobacco, and are intended for human consumption. Of particular interest are ingredients or components obtained or derived from plants or portions of plants from the *Nicotiana* species.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The tobacco used for cigarette manufacture is typically used in blended form. For example, certain popular tobacco blends, commonly referred to as "American blends," comprise mixtures of flue-cured tobacco, burley tobacco and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. However, for many tobacco blends, flue-cured tobacco makes up a relatively large proportion of the blend, while Oriental tobacco makes up a relatively small proportion of the blend. See, for example, *Tobacco Encyclopedia*, Voges (Ed.) p. 44-45 (1984), Browne, The Design of Cigarettes, 3rd Ed., p. 43 (1990) and Tobacco Production, Chemistry and Technology, Davis et al. (Eds.) p. 346 (1999).

Tobacco also may be enjoyed in a so-called "smokeless" form. Particularly popular smokeless tobacco products are employed by inserting some form of processed tobacco or tobacco-containing formulation into the mouth of the user. Various types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; and U.S. Pat. No. 5,387,416 to White et al.; US Pat. Appl. Pub. Nos. 2005/0244521 to Strickland et al. and 2009/0293889 to Kumar et al.; PCT WO 04/095959 to Arnarp et al.; PCT WO 05/063060 to Atchley et al.; PCT WO 05/004480 to Engstrom; PCT WO 05/016036 to Bjorkholm; and PCT WO 05/041699 to Quinter et al., each of which is incorporated herein by reference. See, for example, the types of smokeless tobacco formulations, ingredients, and processing methodologies set forth in US Pat. No. 6,953,040 to Atchley et al. and U.S. Pat. No. 7,032,601 to Atchley et al., each of which is incorporated herein by reference.

One type of smokeless tobacco product is referred to as "snuff." Representative types of moist snuff products, commonly referred to as "snus," have been manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. have been marketed under the tradenames Camel Snus Frost, Camel Snus Original and Camel Snus Spice by R. J. Reynolds Tobacco Company. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard. Representative smokeless tobacco products also have been marketed under the tradenames Oliver Twist by House of Oliver Twist A/S; Copenhagen, Skoal, SkoalDry, Rooster, Red Seal, Husky, and Revel by U.S. Smokeless Tobacco Co.; "taboka" by Philip Morris USA; Levi Garrett, Peachy, Taylor's Pride, Kodiak, Hawken Wintergreen, Grizzly, Dental, Kentucky King, and Mammoth Cave by Conwood Company, LLC; and Camel Orbs, Camel Sticks, and Camel Strips by R. J. Reynolds Tobacco Company.

Through the years, various treatment methods and additives have been proposed for altering the overall character or nature of tobacco materials utilized in tobacco products. For example, additives or treatment processes have been utilized in order to alter the chemistry or sensory properties of the tobacco material, or in the case of smokable tobacco materials, to alter the chemistry or sensory properties of mainstream smoke generated by smoking articles including the tobacco material. The sensory attributes of cigarette smoke can be enhanced by incorporating flavoring materials into various components of a cigarette. Exemplary flavoring additives include menthol and products of Maillard reactions, such as pyrazines, aminosugars, and Amadori compounds. See also, Leffingwell et al., *Tobacco Flavoring for Smoking Products*, R.J. Reynolds Tobacco Company (1972), which is incorporated herein by reference. In some cases, treatment processes involving the use of heat can impart to the processed tobacco a desired color or visual character, desired sensory properties, or a desired physical nature or texture. Various processes for preparing flavorful and aromatic compositions for use in tobacco compositions are set forth in U.S. Pat. No. 3,424,171 to Rooker; U.S. Pat. No. 3,476,118 to Luttich; U.S. Pat. No. 4,150,677 to Osborne, Jr. et al.; U.S. Pat. No. 4,986,286 to Roberts et al.; U.S. Pat. No. 5,074,319 to White et al.; U.S. Pat. No. 5,099,862 to White et al.; U.S. Pat. No. 5,235,992 to Sensabaugh, Jr.; U.S. Pat. No. 5,301,694 to Raymond et al.; U.S. Pat. No. 6,298,858 to Coleman, III et al.; U.S. Pat. No. 6,325,860 to Coleman, III et al.; U.S. Pat. No. 6,428,624 to Coleman, III et al.; U.S. Pat. No. 6,440,223 to Dube et al.; U.S. Pat. No. 6,499,489 to Coleman, III; and U.S. Pat. No. 6,591,841 to White et al.; US Pat. Appl. Publication No. 2004/0173228 to Coleman, III; and U.S. application Ser. No. 12/191,751 to Coleman, III et al., filed Aug. 14, 2008, each of which is incorporated herein by reference.

The sensory attributes of smokeless tobacco can also be enhanced by incorporation of certain flavoring materials. See, for example, US Pat. Appl. Pub. Nos. 2002/0162562 to Williams; 2002/0162563 to Williams; 2003/0070687 to Atchley et al.; 2004/0020503 to Williams, 2005/0178398 to Breslin et al.; 2006/0191548 to Strickland et al.; 2007/0062549 to Holton, Jr. et al.; 2007/0186941 to Holton, Jr. et al.; 2007/

0186942 to Strickland et al.; 2008/0029110 to Dube et al.; 2008/0029116 to Robinson et al.; 2008/0029117 to Mua et al.; 2008/0173317 to Robinson et al.; and 2008/0209586 to Neilsen et al., each of which is incorporated herein by reference.

It would be desirable to provide methods for altering the character and nature of tobacco (and tobacco compositions and formulations) useful in the manufacture of smoking articles and/or smokeless tobacco products.

SUMMARY OF THE INVENTION

The present invention provides materials from *Nicotiana* species (e.g., tobacco-derived materials) comprising isolated components from plants of the *Nicotiana* species useful for incorporation into tobacco compositions utilized in a variety of tobacco products, such as smoking articles and smokeless tobacco products. The invention also provides methods for isolating components from *Nicotiana* species (e.g., tobacco materials), and methods for processing those components and tobacco materials incorporating those components. For example, tobacco-derived materials can be prepared by subjecting at least a portion of a tobacco plant (e.g., leaves, stalks, roots, or stems), but most preferably at least a portion of the tobacco flower, to a separation process, which typically can include multiple sequential extraction steps, in order to isolate desired components of the tobacco material.

The use of *Nicotiana*-derived (e.g., tobacco-derived) materials of the present invention enables the preparation of tobacco compositions for smoking articles or smokeless tobacco compositions that are derived substantially or even entirely from *Nicotiana* materials. For example, a tobacco composition can incorporate tobacco of some form and at least tobacco-derived material such that at least about 80 weight percent, more typically at least about 90 weight percent, or even at least about 95 weight percent (on a dry weight basis), of that tobacco composition consists of tobacco-derived material.

In one aspect, the invention provides a tobacco composition for use in a smoking article or a smokeless tobacco composition comprising an additive derived from a flower of the *Nicotiana* species (e.g., Virginia tobacco, burley tobacco, or *N. alata*). The additive can be a flower of the *Nicotiana* species or a portion thereof in particulate form or in the form of flower isolate derived from a flower of the *Nicotiana* species. In certain embodiments, the flower isolate is in the form of an extract from a flower of the *Nicotiana* species or in the form of a chemically transformed flower isolate, exemplary chemical transformations including acid/base reaction, hydrolysis, thermal treatment, enzymatic treatment, and combinations of such steps. The chemical transformation typically results in a change in the chemical composition of the tobacco isolate, such as an increase in the amount of certain compounds that have desirable sensory characteristics (e.g., aromatic or flavorful compounds).

In one embodiment, the flower isolate is in the form of an extract of an enzymatically-treated flower of the *Nicotiana* species. Exemplary solvents include hydrocarbons such as heptane and hexane.

The tobacco isolate typically contains one or more compounds useful for enhancing the sensory characteristics of the tobacco composition to which the tobacco isolate is added. Exemplary compounds include heptanol, methyloctanoate, 2-methylpropionic acid, 2-methylbutyric acid, 4-ketoisophorone, 4-methylpentanoic acid, hexanoic acid, benzyl alcohol, linalool, phenethyl alcohol, docecylacylate, nerolidol, octanoic acid, eugenol, methozy eugenol, 5-acetoxymethyl-2-furfural, farnesal, 1-hexadecane, 1-octadecene, phytol, acetovanillin, cinnamaldehyde, cinnamyl alcohol, hexadecanoic acid, octadecanoic acid, oleic acid, linolenic acid, phenethyl alcohol, methylbenzoate, salicylaldehyde, benzylsalicylate, cembrenediols, isophorone, oximes, solavetivone, thunbergol, vanillin, acetovanillin, nerolidol, docecylacrylate, cembrenol, benzaldehyde, benylbenzoate, scaral, acetophenone, caryophyllene, and aristolone.

The invention also provides smoking articles and smokeless tobacco compositions that include the flower additives described herein. For example, the invention can provide a tobacco composition wherein the additive is in the form of a casing formulation or a top dressing formulation applied to tobacco strip or wherein the additive is added to a reconstituted tobacco material. Smoking articles or smokeless tobacco compositions incorporating a flower additive of the invention will typically comprise between about 5 ppm and about 5 weight percent of the flower additive based on the total dry weight of the tobacco material in the smoking article or smokeless tobacco product.

In another aspect, the invention provides a method for preparing an additive derived from a flower of the *Nicotiana* species for addition to a tobacco composition, the method comprising: i) receiving a harvested flower or a portion thereof; ii) processing the harvested flower or portion thereof by at least one of subdividing the harvested flower or portion thereof to form a particulate flower material or separating a flower isolate from the harvested flower by subjecting the harvested flower or a portion thereof to solvent extraction, chromatography, distillation, filtration, recrystallization, solvent-solvent partitioning, or a combination thereof; and iii) adding the particulate flower material or flower isolate produced in step ii) to a tobacco composition adapted for use in a smoking article or a smokeless tobacco composition.

In yet another embodiment, the invention provides a method for preparing an additive derived from a flower of the *Nicotiana* species for addition to a tobacco composition, the method comprising separating a flower isolate from a flower of the *Nicotiana* species, said separating step comprising one or more of the following steps: i) collecting vapor-phase components from the headspace surrounding a living flower; and ii) isolating components of a harvested flower by subjecting the harvested flower or a portion thereof to solvent extraction, chromatography, distillation, filtration, recrystallization, solvent-solvent partitioning, or a combination thereof.

Exemplary separating steps include solvent extraction of a harvested flower or a portion thereof using an organic solvent, or subjecting a harvested flower or a portion thereof to enzymatic treatment to form an enzymatically-treated flower material, and then subjecting the enzymatically-treated flower material to solvent extraction to form a tobacco isolate. In one embodiment, the separating step comprises freezing a harvested flower or a portion thereof to form a frozen flower material, processing the frozen flower into a particulate form, subjecting the particulate flower material to an enzymatic treatment to chemically alter the particulate flower material, and extracting the particulate flower material with an organic solvent to produce a tobacco isolate. Exemplary enzymatic treatments include treatment with a glycosidase or a glucocidase.

DETAILED DESCRIPTION OF THE PREFERRED EMBODIMENTS

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

The selection of the plant from the *Nicotiana* species can vary; and in particular, the types of tobacco or tobaccos may vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and *Rustica* tobaccos, as well as various other rare or specialty tobaccos. Descriptions of various types of tobaccos, growing practices and harvesting practices are set forth in *Tobacco Production, Chemistry and Technology*, Davis et al. (Eds.) (1999), which is incorporated herein by reference. Various representative types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al. and U.S. Pat. No. 7,025,066 to Lawson et al.; US Patent Appl. Pub. Nos. 2006/0037623 to Lawrence, Jr. and 2008/0245377 to Marshall et al.; each of which is incorporated herein by reference. Of particular interest are *N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata*, and *N. x sanderae*. Also of interest are *N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina*, and *N. wigandioides*. Other plants from the *Nicotiana* species include *N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia* and *N. spegazzinii.*

*Nicotiana* species can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO 2008/103935 to Nielsen et al.

For the preparation of smokeless and smokable tobacco products, it is typical for harvested plants of the *Nicotiana* species to be subjected to a curing process. Descriptions of various types of curing processes for various types of tobaccos are set forth in *Tobacco Production, Chemistry and Technology*, Davis et al. (Eds.) (1999). Exemplary techniques and conditions for curing flue-cured tobacco are set forth in Nestor et al., *Beitrage Tabakforsch. Int.*, 20, 467-475 (2003) and U.S. Pat. No. 6,895,974 to Peele, which are incorporated herein by reference. Representative techniques and conditions for air curing tobacco are set forth in Roton et al., *Beitrage Tabakforsch. Int.*, 21, 305-320 (2005) and Staaf et al., *Beitrage Tabakforsch. Int.*, 21, 321-330 (2005), which are incorporated herein by reference. Certain types of tobaccos can be subjected to alternative types of curing processes, such as fire curing or sun curing. Preferably, harvested tobaccos that are cured are then aged.

At least a portion of the plant of the *Nicotiana* species (e.g., at least a portion of the tobacco portion) can be employed in an immature form. That is, the plant, or at least one portion of that plant, can be harvested before reaching a stage normally regarded as ripe or mature. As such, for example, tobacco can be harvested when the tobacco plant is at the point of a sprout, is commencing leaf formation, is commencing flowering, or the like.

At least a portion of the plant of the *Nicotiana* species (e.g., at least a portion of the tobacco portion) can be employed in a mature form. That is, the plant, or at least one portion of that plant, can be harvested when that plant (or plant portion) reaches a point that is traditionally viewed as being ripe, over-ripe or mature. As such, for example, through the use of tobacco harvesting techniques conventionally employed by farmers, Oriental tobacco plants can be harvested, burley tobacco plants can be harvested, or Virginia tobacco leaves can be harvested or primed by stalk position.

After harvest, the plant of the *Nicotiana* species, or portion thereof, can be used in a green form (e.g., tobacco can be used without being subjected to any curing process). For example, tobacco in green form can be frozen, freeze-dried, subjected to irradiation, yellowed, dried, cooked (e.g., roasted, fried or boiled), or otherwise subjected to storage or treatment for later use. Such tobacco also can be subjected to aging conditions.

In accordance with the present invention, a tobacco product incorporates tobacco that is combined with some form of the flower of a plant of at least one *Nicotiana* species. That is, a portion of the tobacco product can be composed of some form of the flower of a *Nicotiana* species, such as parts or pieces of the flower, or processed materials incorporating processed flower or components thereof. At least a portion of the tobacco product can be composed of components of the flower, such as ingredients removed from the flower (e.g., by extraction, distillation, or other types of processing techniques). At least a portion of the tobacco product can be composed of components derived from the flower, such as components collected after subjecting the flower to chemical reaction or after subjecting components collected from the flower to chemical reaction (e.g., acid/base reaction conditions or enzymatic treatment).

The flower is the characteristic reproductive structure (e.g., seed producing structure) of the plant of the *Nicotiana* species. For example, a tobacco flower is the flower characteristic of a tobacco plant. Flowers of various types of representative *Nicotiana* species are depicted in, Schiltz et al., *Les Plantes du G. Nicotiana en Collection a L'Institut du Tabac de Bergerac*, $2^{nd}$ Ed. (Seita) (1991).

The *Nicotiana* species can be selected for the type of flower that it produces. For example, plants can be selected on the basis that those plants produce relatively large sized flowers, numerous flowers, flowers that incorporate relatively high levels of specific desired components, and the like.

The *Nicotiana* species of plant can be grown under agronomic conditions so as to promote flower development. Tobacco plants can be grown in greenhouses, growth chambers, or outdoors in fields, or grown hydroponically.

The flower is harvested from the *Nicotiana* species of plant. The manner by which the flower is harvested can vary. Harvest of flowers traditionally has been referred to as "picking" As such, the flower is removed from the rest of the plant by cutting or breaking the stem or pedicle that connects the flower from the rest of the plant. Alternatively, components of the flower can be isolated by collecting vapor-phase components from the headspace in the vicinity of a living flower (i.e., a flower that has not been removed or picked from the plant), such as by capturing vapor-phase components from the headspace of a growth chamber containing a living flower.

Various parts or portions of flower can be employed. For example, virtually all of the flower (e.g., the whole flower) can be harvested, and employed as such. Alternatively, various parts or pieces of the flower can be harvested or separated for further use after harvest. For example, the petal, corolla, sepal, receptacle, anther, filament, stigma, stamen, style, pistil, pedicel, ovary, and various combinations thereof, can be isolated for further use or treatment.

The time of harvest during the life cycle of the flower can vary. For example, the flower can be harvested when it is in the form of a bud, when it is closed prior to bloom, during bloom, or after bloom is complete.

The flower can be harvested at different times of the day. For example, the flower can be harvested during the morning hours or the afternoon hours (i.e., during daylight hours), or at night time (i.e., when it is dark). The flower can be harvested when it is dry, or when it is wet (e.g., after being exposed to rain or irrigation).

The post-harvest processing of the flower can vary. After harvest, the flower, or portion thereof, can be used in a green form (e.g., the flower can be used without being subjected to any curing process). For example, the flower can be used without being subjected to significant storage, handling or processing conditions. In certain situations, it is preferable that the fresh flower be used virtually immediately after harvest. Alternatively, for example, a flower in green form can be refrigerated or frozen for later use, freeze dried, subjected to irradiation, yellowed, dried, cured (e.g., using air drying techniques or techniques that employ application of heat), heated or cooked (e.g., roasted, fried or boiled), or otherwise subjected to storage or treatment for later use.

The harvested flower can be physically processed. The flower can be separated into individual parts or pieces (e.g., the petals can be removed from the remaining portion of the flower). The flower, or parts thereof, can be further subdivided into parts or pieces (e.g., the flower can be shredded, cut, comminuted, pulverized, milled or ground into pieces or parts that can be characterized as filler-type pieces, granules, particulates or fine powders). The flower, or parts thereof, can be subjected to external forces or pressure (e.g., by being pressed or subjected to roll treatment). When carrying out such processing conditions, the flower can have a moisture content that approximates its natural moisture content (e.g., its moisture content immediately upon harvest), a moisture content achieved by adding moisture to the flower, or a moisture content that results from the drying of the flower. For example, powdered, pulverized, ground or milled pieces of flower can have moisture contents of less than about 25 weight percent, often less than about 20 weight percent, and frequently less than about 15 weight percent. As such, parts or pieces of the flower can be used as such as components of tobacco products, or processed further.

The harvested flower can be subjected to other types of processing conditions. For example, components of the flower can be separated from one another, or otherwise fractionated into chemical classes or mixtures of individual compounds. Typical separation processes can include one or more process steps (e.g., solvent extraction using polar solvents, organic solvents, or supercritical fluids), chromatography, distillation, filtration, recrystallization, and/or solvent-solvent partitioning. Exemplary extraction and separation solvents or carriers include water, alcohols (e.g., methanol or ethanol), hydrocarbons (e.g., heptane and hexane), diethyl ether methylene chloride and supercritical carbon dioxide. Exemplary techniques useful for extracting components from *Nicotiana* species are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated herein by reference. See also, the types of separation techniques set forth in Brandt et al., *LC-GC Europe*, p. 2-5 (March, 2002) and Wellings, *A Practical Handbook of Preparative HPLC* (2006), which are incorporated herein by reference. In addition, the flower or components thereof can be subjected to the types of treatments set forth in Ishikawa et al., *Chem. Pharm. Bull.,* 50, 501-507 (2002); Tienpont et al., *Anal. Bioanal. Chem.,* 373, 46-55 (2002); Ochiai, *Gerstel Solutions Worldwide,* 6, 17-19 (2006); Coleman, III, et al., *J. Sci. Food and Agric.,* 84, 1223-1228 (2004); Coleman, III et al., *J. Sci. Food and Agric.,* 85, 2645-2654 (2005); Pawliszyn, ed., *Applications of Solid Phase Microextraction, RSC Chromatography Monographs*, (Royal Society of Chemistry, UK) (1999); Sahraoui et al., *J. Chrom.,* 1210, 229-233 (2008); and U.S. Pat. No. 5,301,694 to Raymond et al., which are incorporated herein by reference.

Components of the flower, or portions of the flower, can be isolated. As used herein, an "isolated component" or "flower isolate" is a compound or complex mixture of compounds separated from a flower of a plant of the *Nicotiana* species. The isolated component can be a single compound, a homologous mixture of similar compounds (e.g., isomers of a flavor compound), or a heterologous mixture of dissimilar compounds (e.g., a complex mixture of various compounds of different types, preferably having desirable sensory attributes).

Examples of the types of components that can be present in flower isolates include terpenes, sesqui-terpenes, diterpenes, esters (e.g., terpenoid esters and fatty acid esters), alcohols, aldehydes, ketones, carboxylic acids, lactones, anhydrides, phenols quinones, ethers, nitriles, amines, amides, imides, nitroalkanes, nitrophenols, nitroarenes, nitrogen-containing heterocyclics, lactams, oxazoles, aza-arenes, sulfur-containing compounds, alkaloids (e.g., nicotine), plastid pigments (e.g., chlorophylls or carotenoids), lipids (e.g., phytosterols), and derivatives thereof. Additional examples of representative components that can be employed are described as natural tar diluents in PCT WO 2007/012980 to Lipowicz, which is incorporated herein by reference.

Components of the flower can be subjected to conditions so as to cause those components (whether as part of the flower or in the form of an isolated component) to undergo chemical transformation. For example, flower isolates that have been separated from the flower can be treated to cause chemical transformation or be admixed with other ingredients. The chemical transformations or modification of the flower isolate can result in changes of certain chemical and physical properties of those flower isolates (e.g., the sensory attributes of those isolates). Exemplary chemical modification processes can be carried out by acid/base reaction, hydrolysis, heating (e.g., a thermal treatment where the flower isolate is subjected to an elevated temperature such as a temperature of at least about 50° C. or at least about 75° C. or at least about 90° C.), and enzymatic treatments (e.g., using glycosidase or glucocidase); and as such, components of the flower isolate can undergo esterification, transesterification, isomeric conversion, actetal formation, acetal decomposition, invert sugar reactions, and the like. Exemplary types of further ingredients that can be admixed with the flower isolates include flavorants, fillers, binders, pH adjusters, buffering agents, colorants, disintegration aids, antioxidants, humectants and preservatives.

The flowers and components of flower isolates are useful as additives for tobacco compositions, particularly tobacco compositions incorporated into smoking articles or smokeless tobacco products. Addition of the flower isolates to a tobacco composition can enhance a tobacco composition in a variety of ways, depending on the nature of the flower isolate and the type of tobacco composition. Exemplary flower isolates can serve to provide flavor and/or aroma to a tobacco product (e.g., composition that alters the sensory characteristics of tobacco compositions or smoke derived therefrom).

A variety of compounds having distinctive flavor and aroma characteristics can be isolated from flowers of plants of the *Nicotiana* species. Certain of those compounds can be considered to be volatile under normal ambient conditions of temperature, humidity and air pressure. Preferred compounds exhibit positive sensory attributes at relatively low concentrations. For example, a suitable flower can provide compounds such as 4-ketosiophorone, phytol, phenethyl alcohol, benzyl alcohol, linalool, various cembrenol isomers, various cembrenediols, isophorone, methylbenzoate, salicylaldehyde, benzylsalicylate, methozy eugenol, thunbergol, various carboxylic acids, various oximes, benzaldehyde, benylbenzoate, scaral, acetophenone, caryophyllene, cinnamaldehyde, cinnamyl alcohol, various cyclohexene-butanone isomers, solavetivone, farnesal, farnesol, and the like. Each of those types of compounds can be isolated in relatively pure form. See, for example, Raguso et al., *Phytochemistry,* 63, 265-284 (2003) and Bauer et al., *Common Fragrance and Flavor Materials, Preparation, Properties and Uses*, VCH, Federal Republic of Germany (1985). In addition, compounds having distinctive flavor and aroma characteristics can be chemically bound, such as in the form of glycosidically bound compounds. See, for example, Loughrin et al., *Phytochemistry,* 31, 1537-1540 (1992); Kodama et al., *Agric. Biol. Chem.,* 45, 941-944 (1981); Matsumura et al., *Chem. Pharm. Bull.,* 50, 66-72 (2002); and Ishikawa et al., *Chem. Pharm. Bull.,* 50, 501-507 (2002).

The form of the flower isolate can vary. Typically, the flower isolate is in a solid, liquid, or semi-solid or gel form. The flower isolate can be used in concrete, absolute, or neat form. Solid forms of the flower isolate include spray-dried and freeze-dried forms. Liquid forms of the flower isolate include isolates contained within aqueous or organic solvent carriers.

The flower, processed flower and flower isolates can be employed in a variety of forms. The harvested flower or flower isolate can be employed as a component of processed tobaccos. In one regard, the flower, or components thereof, can be employed within a casing formulation for application to tobacco strip (e.g., using the types of manners and methods set forth in U.S. Pat. No. 4,819,668 to Shelar, which is incorporated herein by reference) or within a top dressing formulation. Alternatively, the flower, or components thereof, can be employed as an ingredient of a reconstituted tobacco material (e.g., using the types of tobacco reconstitution processes generally set forth in U.S. Pat. No. 5,143,097 to Sohn; U.S. Pat. No. 5,159,942 to Brinkley et al.; U.S. Pat. No. 5,598,868 to Jakob; U.S. Pat. No. 5,715,844 to Young; U.S. Pat. No. 5,724,998 to Gellatly; and U.S. Pat. No. 6,216,706 to Kumar, which are incorporated herein by reference). The flower, or components thereof, also can be incorporated into a cigarette filter (e.g., in the filter plug, plug wrap, or tipping paper) or incorporated into cigarette wrapping paper, preferably on the inside surface, during the cigarette manufacturing process.

The *Nicotiana* flower, processed flower and flower isolates can be incorporated into smoking articles. Representative tobacco blends, non-tobacco components, and representative cigarettes manufactured therefrom, are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; and U.S. Pat. No. 5,360,023 to Blakley et al.; US Pat. Application 2002/0000235 to Shafer et al.; and PCT WO 02/37990. Those tobacco materials also can be employed for the manufacture of those types of cigarettes that are described in U.S. Pat. No. 4,793,365 to Sensabaugh; U.S. Pat. No. 4,917,128 to Clearman et al.; U.S. Pat. No. 4,947,974 to Brooks et al.; U.S. Pat. No. 4,961,438 to Korte; U.S. Pat. No. 4,920,990 to Lawrence et al.; U.S. Pat. No. 5,033,483 to Clearman et al.; U.S. Pat. No. 5,074,321 to Gentry et al.; U.S. Pat. No. 5,105,835 to Drewett et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,247,949 to Deevi et al.; U.S. Pat. No. 5,551,451 to Riggs et al.; U.S. Pat. No. 5,285,798 to Banerjee et al.; U.S. Pat. No. 5,593,792 to Farrier et al.; U.S. Pat. No. 5,595,577 to Bensalem et al.; U.S. Pat. No. 5,816,263 to Counts et al.; U.S. Pat. No. 5,819,751 to Barnes et al.; U.S. Pat. No. 6,095,153 to Beven et al.; U.S. Pat. No. 6,311,694 to Nichols et al.; and U.S. Pat. No. 6,367,481 to Nichols, et al.; US Pat. Appl. Pub. No. 2008/0092912 to Robinson et al.; and PCT WO 97/48294 and PCT WO 98/16125. See, also, those types of commercially marketed cigarettes described *Chemical and Biological Studies on New Cigarette Prototypes that Heat Instead of Burn Tobacco*, R. J. Reynolds Tobacco Company Monograph (1988) and *Inhalation Toxicology,* 12:5, p. 1-58 (2000).

The *Nicotiana* flower, processed flower and flower isolates can be incorporated into smokeless tobacco product, such as loose moist snuff, loose dry snuff, chewing tobacco, pelletized tobacco pieces (e.g., having the shapes of pills, tablets, spheres, coins, beads, obloids or beans), extruded or formed tobacco strips, pieces, rods, cylinders or sticks, finely divided ground powders, finely divided or milled agglomerates of powdered pieces and components, flake-like pieces, molded processed tobacco pieces, pieces of tobacco-containing gum, rolls of tape-like films, readily water-dissolvable or water-dispersible films or strips (e.g., US Pat. App. Pub. No. 2006/0198873 to Chan et al.), or capsule-like materials possessing an outer shell (e.g., a pliable or hard outer shell that can be clear, colorless, translucent or highly colored in nature) and an inner region possessing tobacco or tobacco flavor (e.g., a Newtoniam fluid or a thixotropic fluid incorporating tobacco of some form). Various types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; and U.S. Pat. No. 5,387,416 to White et al.; US Pat. App. Pub. Nos. 2005/0244521 to Strickland et al. and 2008/0196730 to Engstrom et al.; PCT WO 04/095959 to Arnarp et al.; PCT WO 05/063060 to Atchley et al.; PCT WO 05/016036 to Bjorkholm; and PCT WO 05/041699 to Quinter et al., each of which is incorporated herein by reference. See also, the types of smokeless tobacco formulations, ingredients, and processing methodologies set forth in U.S. Pat. No. 6,953,040 to Atchley et al. and U.S. Pat. No. 7,032,601 to Atchley et al.; US Pat. Appl. Pub. Nos. 2002/0162562 to Williams; 2002/0162563 to Williams; 2003/0070687 to Atchley et al.; 2004/0020503 to Williams, 2005/0178398 to Breslin et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; and 2008/0209586 to Neilsen et al., each of which is incorporated herein by reference.

The amount of flower or flower isolate added to a tobacco composition, or otherwise incorporated within a tobacco composition or tobacco product, can depend on the desired function of that flower component, the chemical makeup of that component, and the type of tobacco composition to which the flower component is added. The amount added to a tobacco composition can vary, but will typically not exceed about 5 weight percent based on the total dry weight of the tobacco composition to which the flower or flower isolate is added. When the flower is employed within a smoking article, the amount of flower will typically be at least about 5 ppm, generally at least about 10 ppm, and often at least about 100 ppm, based on the total dry weight of the tobacco material within the smoking article; but will typically be less than about 5 percent, generally less than 2 percent, and often less than about 1 percent, based on the total dry weight of the tobacco material within the smoking article. When the flower is employed within a smokeless tobacco product, the amount of flower will typically be less at least about 5 ppm, generally at least about 10 ppm, and often at least about 100 ppm, based on the total dry weight of the tobacco material within the smokeless tobacco product; but will typically be less than about 5 percent, generally less than 2 percent, and often less than about 1 percent, based on the total dry weight of the tobacco material within the smokeless tobacco product.

EXPERIMENTAL

Aspects of the present invention is more fully illustrated by the following examples, which are set forth to illustrate certain aspects of the present invention and are not to be construed as limiting thereof.

Example 1

Living *N. alata* flowers that had been growing in a growth chamber under a 16 hour day and 8 hour night lighting regime are picked at a time that represents the lighting found at night (i.e., at approximately 10 pm). Those flowers are immediately contacted with an organic solvent in order to provide a mixture. That is, about 5 to 6 freshly picked flowers are mixed with roughly 50 mL of heptane in an extraction vessel, and as such, a total of eight extraction vessels containing roughly identical ingredients are provided.

Each of the mixtures is promptly subjected to extraction conditions. That is, each extraction vessel is processed for about 20 minutes using a microwave accelerated extraction system (e.g., a MARSX Model No. 907600 available from CEM Corp. MARSX) that can be set at about 69° C. As such, various components of the flowers are extracted from the flowers and become dissolved or dispersed within the heptane.

The extraction vessels are cooled to less than 10° C. over a roughly 2 hour period. Then, the heptane is removed from the samples at about 40° C. using rotary evaporation techniques and a stream of dry nitrogen, so as to provide a final volume of about 2 mL. The resulting cloudy extract is then filtered through a 0.45 μM Whatman PTFE Autovial, and a small amount of dry sodium sulfate is added to the collected extract to remove residual water. The resulting clear, slightly yellow-green extract then is analyzed using gas chromatographic/mass spectrometric (GC/MS) techniques.

Extracted flower components that are identified as peaks using GC/MS analysis techniques include various waxes (e.g., long chain hydrocarbons), carboxylic acids and carboxylic acid esters, as well as various other components that possess sensory attributes. Those components include isomers of heptanol, methyloctanoate, 2-methylpropionic acid, 2-methylbutyric acid, 4-ketoisophorone, 4-methylpentanoic acid, hexanoic acid, phenethyl alcohol, docecylacylate, nerolidol, octanoic acid, eugenol, 5-acetoxymethyl-2-furfural, farnesal isomers, 1-hexadecane, 1-octadecene, phytol, acetovanillin, hexadecanoic acid, octadecanoic acid, oleic acid, linolenic acid, vanillin, acetovanillin, nerolidol, docecylacrylate and aristolone.

Example 2

Living *N. alata* flowers that had been growing in a growth chamber under a 16 hour day and 8 hour night lighting regime are picked. Those flowers are immediately frozen in liquid nitrogen; and then removed, crushed and powdered in a mortar and pestle while being exposed to liquid nitrogen. The resulting crushed flowers, which weigh about 20 g to about 32 g on a wet weight basis, are subjected to enzymatic treatment using 100 mg of β-Glucosidase from almonds (≥2 units/mg). The suspensions are placed into a 45° C. water bath for 48 hours, after which hexane extraction is performed. The hexane is evaporated to about 2.0 mL. The hexane extract is then analyzed by GC-MS. Benzaldehyde, benzyl alcohol, phenethyl alcohol, benzyl acetate and linalool are identified as components of the extract; and the amount of those compounds within the extract are at higher levels as compared to a similar extract not subjected to enzymatic treatment. It is believed that enzymatic treatment of the flower can enhance release of certain desirable flavorful or aromatic compounds, which results in a more productive solvent extraction step. As noted, greater amounts of certain compounds were obtained by first subjecting the flower to enzymatic treatment and then treating the resulting material with a solvent.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A method for preparing a tobacco composition, the method comprising:

treating a harvested flower of the *Nicotiana* species or a portion thereof with an enzyme selected from the group consisting of a glycosidase and a glucocidase to form an enzymatically-treated flower material;

(ii) separating a flower isolate from the enzymatically-treated flower material, said separating step comprising subjecting the enzymatically-treated flower material to solvent extraction, chromatography, distillation, filtration, recrystallization, solvent-solvent partitioning, or a combination thereof, wherein the flower isolate contains at least one flavorful or aromatic compound selected from the group consisting of benzaldehyde, benzyl alcohol, phenethyl alcohol, benzyl acetate, and linalool; and (iii) adding the flower isolate to a tobacco composition adapted for use in a smoking article or a smokeless tobacco composition.

2. The method of claim 1, wherein the separating step comprises solvent extraction of the enzymatically-treated flower material using an organic solvent.

3. The method of claim 1, wherein the method further comprises freezing the harvested flower or a portion thereof to form a frozen flower material and processing the frozen flower material into a particulate form prior to said treating step.

4. The method of claim 1, wherein the *Nicotiana* species is *N. alata*.

5. The method of claim 1, wherein the *Nicotiana* species is selected from the group consisting of *N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N. x sanderae, N. africana, N. amplexicaulis, N. benavidesii, N. bonariensis, N. debneyi, N. longiflora, N, maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N, petunioides, N. quadrivalvis, N. repanda, N. rotundifolia, N. solanifolia* and *N. spegazzinii*.

6. The method of claim 1, wherein the flower isolate is chemically transformed by one or more of acid/base reaction, hydrolysis, and thermal treatment.

7. The method of claim 1, wherein the separating step comprises solvent extraction of the enzymatically-treated flower material using a solvent selected from the group consisting of methanol, ethanol, heptane, hexane, supercritical fluids, and combinations thereof.

8. The method of claim 1, wherein the flower isolate comprises one or more compounds selected from the group consisting of heptanol, methyloctanoate, 2-methylpropionic acid, 2-methylbutyric acid, 4-ketoisophorone, 4-methylpentanoic acid, hexanoic acid, docecylacylate, nerolidol, octanoic acid, eugenol, methoxy eugenol, 5-acetoxymethyl-2-furfural, farnesal, 1- hexadecane, 1-octadecene, phytol, cinnamaldehyde, cinnamyl alcohol, hexadecanoic acid, octadecanoic acid, oleic acid, linolenic acid, methylbenzoate, salicylaldehyde, benzylsalicylate, cembrenediols, isophorone, oximes, solavetivone, thunbergol, vanillin, acetovanillin, docecylacrylate, cembrenol, benzylbenzoate, scaral, acetophenone, caryophyllene, and aristolone.

9. The method of claim 1, wherein the flower isolate is in the form of a casing formulation or a top dressing formulation applied to tobacco strip or in the form of an additive for a reconstituted tobacco material.

10. The method of claim 1, wherein the tobacco composition comprises a tobacco material adapted for use in a smoking article.

11. The method of claim 10, wherein the amount of flower isolate in the tobacco composition is between about 5 ppm and about 5 weight percent based on the total dry weight of the tobacco material in the smoking article.

12. The method of claim 1, wherein the tobacco composition comprises a tobacco material adapted for use in a smokeless tobacco product.

13. The method of claim 12, wherein the amount of flower isolate in the tobacco composition is between about 5 ppm and about 5 weight percent based on the total dry weight of the tobacco material in the smokeless tobacco product.

14. The method of claim 1, wherein the *Nicotiana* species is Virginia tobacco or burley tobacco.

* * * * *